US006637052B2

(12) United States Patent
Nockles

(10) Patent No.: US 6,637,052 B2
(45) Date of Patent: Oct. 28, 2003

(54) ALLERGEN-AVOIDANCE BEDS

(75) Inventor: Helen Louise Nockles, East Molesey (GB)

(73) Assignee: The Pilgrim Bed Limited, East Molesey (GB)

( * ) Notice: Subject to any disclaimer, the term of this patent is extended or adjusted under 35 U.S.C. 154(b) by 0 days.

(21) Appl. No.: 10/280,506

(22) Filed: Oct. 25, 2002

(65) Prior Publication Data

US 2003/0056289 A1 Mar. 27, 2003

Related U.S. Application Data

(63) Continuation of application No. 09/284,170, filed as application No. PCT/GB97/02647 on Sep. 26, 1997, now abandoned.

(30) Foreign Application Priority Data

Oct. 11, 1996 (GB) ..... 9621251

(51) Int. Cl.[7] ..... A47C 19/00

(52) U.S. Cl. ..... 5/131; 5/132; 5/53.1; 5/201; 5/282.1; 5/285

(58) Field of Search ..... 5/131, 132, 53.1, 5/285, 400, 411, 412, 200.1, 201, 236.1, 238, 240, 282.1, 280, 907; D6/393

(56) References Cited

U.S. PATENT DOCUMENTS

| | | | | |
|---|---|---|---|---|
| 275,202 A | | 4/1883 | Hammerschmidt | |
| 448,209 A | | 3/1891 | Chorlton et al. | |
| 1,508,406 A | * | 9/1924 | Nicolosi | 5/29 |
| 2,115,434 A | | 4/1938 | Stuart et al. | |
| 2,665,433 A | | 1/1954 | Weidt | |
| 2,724,127 A | * | 11/1955 | Trivas et al. | 5/53.1 |
| 3,822,425 A | | 7/1974 | Scales | |
| D240,547 S | * | 7/1976 | Stanley et al. | D21/520 |
| 5,231,717 A | | 8/1993 | Scott et al. | |
| D370,794 S | * | 6/1996 | Mann et al. | D6/393 |
| 5,544,943 A | | 8/1996 | Durling | |

FOREIGN PATENT DOCUMENTS

| | | |
|---|---|---|
| CH | 667196 | 9/1988 |
| DE | 8633219 | 3/1987 |
| FR | 2222977 | 10/1974 |

* cited by examiner

*Primary Examiner*—Lynne H. Browne
*Assistant Examiner*—James M. Hewitt
(74) *Attorney, Agent, or Firm*—Richard M. Goldberg

(57) ABSTRACT

The wooden bed frame shown in the figures is designed to reduce the effect of the house dust mite upon a sleeper allergic to such mites. The bed incorporates a number of features each of which contribute to reduce asthma attacks for sleepers sensitive to the house dust mite. The bed frame includes a footboard (2) and a headboard (1) outwardly inclined at an angle of between 5° and 25°, preferably at 15°, to the vertical. The headboard (1) and footboard (2), both extend beyond the width of an air mattress (not shown) lying between stringers (3 and 4) to ensure good circumjacent air circulation even when located against a wall. The mattress is supported on slats (6) mounted between the stringers (3 and 4). In use the air mattress may be covered by a quilted cotton material that is readily washed and dried so that it does not act as a natural host for house dust mites. The pillow (not shown) is enveloped in a zipped non-woven micro-porous pillowcase that is designed to exclude house dust mites from entering the pillow.

18 Claims, 6 Drawing Sheets

ALLERGEN-AVOIDANCE BEDS

BACKGROUND OF THE INVENTION

The invention relates to beds particularly for asthma sufferers sensitive to the House Dust Mite. The bed is designed to create an environment that reduces a trigger for asthma attacks, and to remind a user that: (i) good air circulation; (ii) regularly washed cotton material adjacent to the user; (iii) the inter positioning of a non-woven micro-porous membrane between the user and the natural scavenger, the House Dust Mite; and, (iv) a readily cleaned mattress, all contribute to an allergen-free sleeping environment.

The droppings of House Dust Mites (*Dermatophagoides pteronyssinus*), translated from the Latin as "skin-eater on a feather", are a known major cause of asthma symptoms and the cause of sleepless nights for asthma sufferers sensitive to the House Dust Mite. The Mites colonize many Household items, including mattresses and bedding. These Mites need damp and dark conditions. The Mites live on skin scales and produce feces pellets with a size of 10 to 20 microns. The metabolism of House Dust Mites can only digest the human skin scales, which are constantly shed by everybody, after they have been encrusted with a fungus that derives from mold found in damp dark conditions. Therefore, by maintaining dry clean bedding the fungus cannot grow on the skin scales thus denying the House Dust Mite of its major source of food.

Depending upon the size of the person, a human being can perspire up to about one liter of fluid each night. This provides the source of liquid for the mold to develop in bedding. The dark warm conditions of a bed also encourage the fungus to propagate on discarded skin scales trapped within the bedding.

It has been found that geographical distribution of the House Dust Mite which cause an allergic reaction in some asthma sufferers occurs mainly in countries lying in two belts lying above the tropic of Capricorn and below the tropic of Cancer.

According to an article on May 26, 1997 in Time and Newsweek, entitled "The scary spread of Asthma" it cites a 61% increase in asthma since the early 1980's, however, deaths from asthma peaked in 1989 and have since shown a steady decline of 6%. A study sponsored by the UK National Asthma Council (now the National Asthma Campaign) in 1982 carried out by a team led by Dr. Thomas Platts-Mills concluded in a report published in The Lancet of Sep. 25, 1982 that: "Avoidance of important allergens seems not only to result in clinical remission but in many cases there was a reduction of bronchial hypersensitivity."

The findings indicate that the major cause of asthma is from "indoor" air. "Outdoor" air pollution such as from vehicles is a lesser cause of asthma symptoms but considerable efforts are being made currently to reduce the emission from vehicles. This is expected to have little effect upon the incidence of asthma sufferers. Therefore the problem of asthma requires a solution to improve the quality of "indoor" air, particularly pollution caused by House Dust Mites.

The growing asthma problem in people sensitive to the House Dust Mite can be tackled by breaking into the chain leading to the distribution of allergens from House Dust Mites. Each of the following four actions help to break the chain:

(i) ensuring good air flow around the bed;

(ii) eliminating access to the mattress's internal spaces;

(iii) providing readily washable bedding;

(iv) providing a pillow-slip inter-liner which seeks to prevent House Dust Mites and shed skin scales from entering the filling material of the pillow.

Additionally, the bedding should be regularly washed and aired.

The invention helps to facilitate the above four actions by:

(i) providing a bed that is held away from adjacent walls;

(ii) providing an air mattress on a slatted base;

(iii) utilising cotton bedding for covering the mattress to absorb perspiration and skin scales;

(iv) providing a non-woven micro-porous cotton pillow slip in which the openable side is sealed by a fine zip fastener.

It is known to provide beds with headboards that are wider than the width of the mattress or bed base. A substantially S-contoured headboard and similarly contoured footboard is known on a bed generally called a "sleigh bed" which has non-planar endboards with straight top edges and sides. It is also known to provide beds with buffers, in the form of rubber cylinders, that displace the headboard or footboard about 2 cm. from an adjacent wall. Air-filled mattresses, and dust filtering cotton covering materials and cotton padding are also well known.

There is disclosed in De-U 8 633 219 a bed having a headboard which is inclined outwardly from the bed.

SUMMARY OF THE INVENTION

The present invention utilises a combination of features that have been found to substantially lessen asthma attacks in people sensitive to the House Dust Mite. A bed according to the present invention has a headboard and footboard that are inclined outward and extend laterally beyond the width of a support means for a mattress, to ensure that the first of the four actions listed above is achieved.

According to the present invention there is provided an allergen-avoidance bed comprising two end boards forming a headboard and a footboard, a pair of stringers for connecting the headboard to the footboard and a mattress base support for supporting an air-mattress, wherein, in use, at least one of the end boards is substantially planar and inclined outwardly from the bed at a first angle between 5° and 25° to the vertical, wherein the said one end board has an edge which is shaped to provide a curvilinear edge to optimise air flow around the end board.

Preferably the first end board is the headboard and the other end board is the footboard and is also planar and similarly shaped to the said one end board and inclined outwardly from the bed at a second angle to optimise air flow around the other end board.

Preferably, the end boards extend laterally by the same distance from the stringers so as to space the bed from an adjacent side wall to allow air flow around that side of the bed.

The first and second angles are preferably equal, and substantially at 15°, and the means for supporting the mattress is a series of parallel wooden slats mounted on two rubber coated fabric belts extending between a beam adjacent the headboard and a beam adjacent the footboard.

Both of the substantially identical plank-like stringers are mounted in parallel between the headboard and the footboard. The inside face of both stringers is provided with a rail on which the ends of the slats rest.

The stringers may be smoothly shaped along their length so that the depth of the stringers are greater at their ends than at their centre. The shaping may be achieved by making the upper edge to be curved at a lesser radius than the curvature of the lower edge.

The stringers may be provided with tongues arranged to pass through co-operating slots in the headboard and footboard and each held in place by a wedge engaging a hole in the portion of the tongue which in use protrudes through the footboard and headboard. Alternatively, the stringers may be secured to the headboard and footboard by brackets, screws, glue or other securing means.

The bed may be flat-packed. The pack may contain an air-mattress, a cotton covered quilt filled with padding consisting of cotton or easily washed and dried synthetic material. A cover for a pillow may also be included in the pack. Preferably the cover is made from a non-woven micro-porous fabric that prevents substantially all skin scales from passing therethrough.

The pillow cover is preferably closed on one side by a fine zip fastening. If a pillow is included in the pack it is preferably filled with an easily washed and dried synthetic material such as crimped Terelene®, known types of hollow fibre material.

The bed frame is preferably constructed from wood that has rounded corners and is sealed with a wax finish or a clear varnish such as a non-allergenic paint like polyurethane.

DESCRIPTION OF THE DRAWINGS

The invention will now be described by way of example with reference to the accompanying diagrammatic drawings in which.

DETAILED DESCRIPTION

Figure 1:
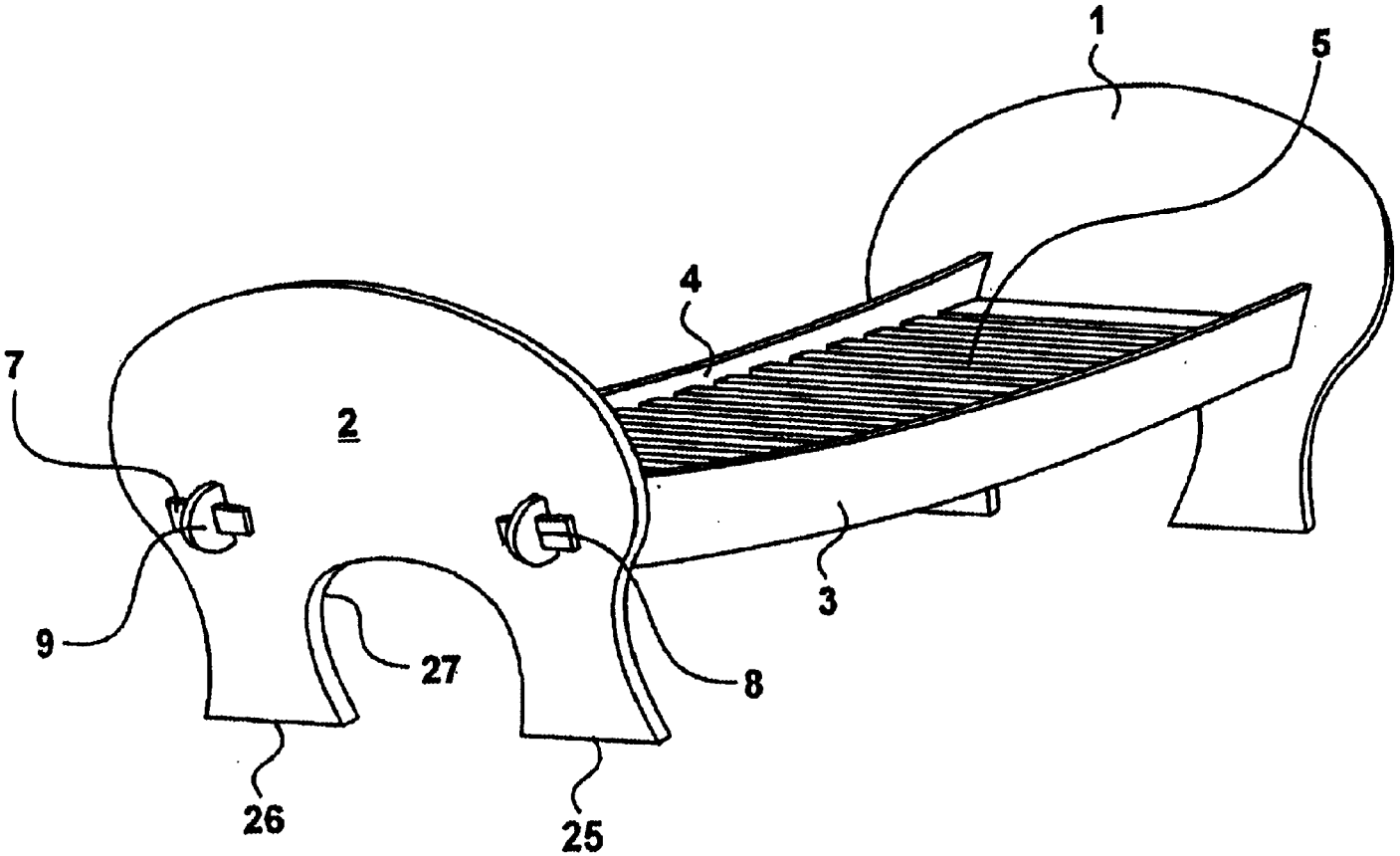
FIG. 1 shows a perspective view of a bed frame according to the invention.
Figure 2:
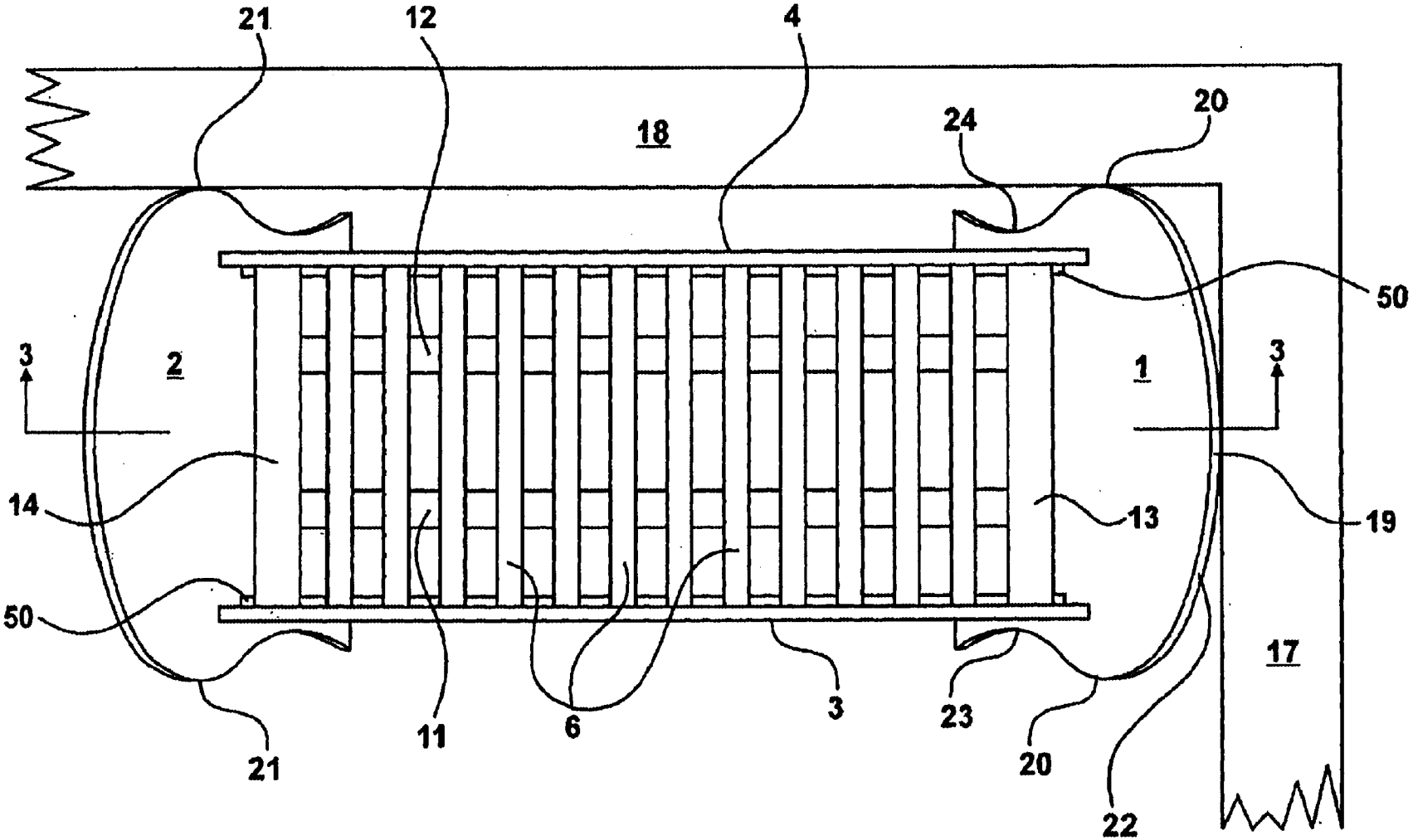
FIG. 2 shows the bed frame in plan view in place in the corner of a room.
Figure 4A:
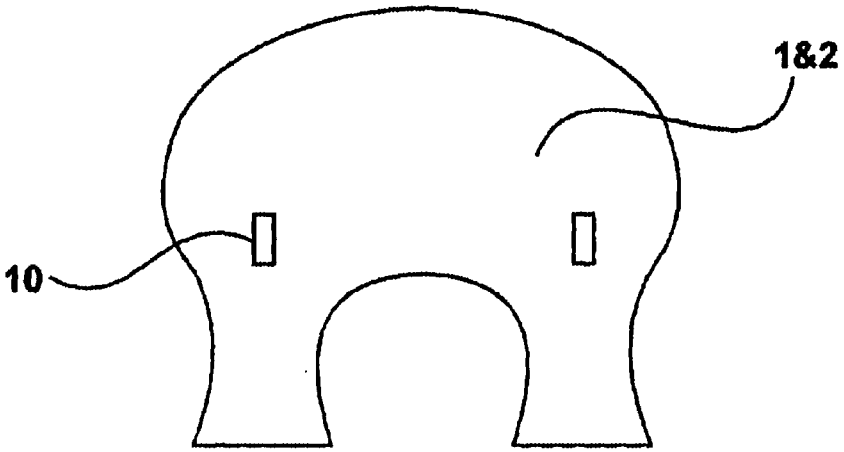
FIGS. 4*a* to 4*d* illustrate the components of the bed frame before assembly.
Figure 4B:
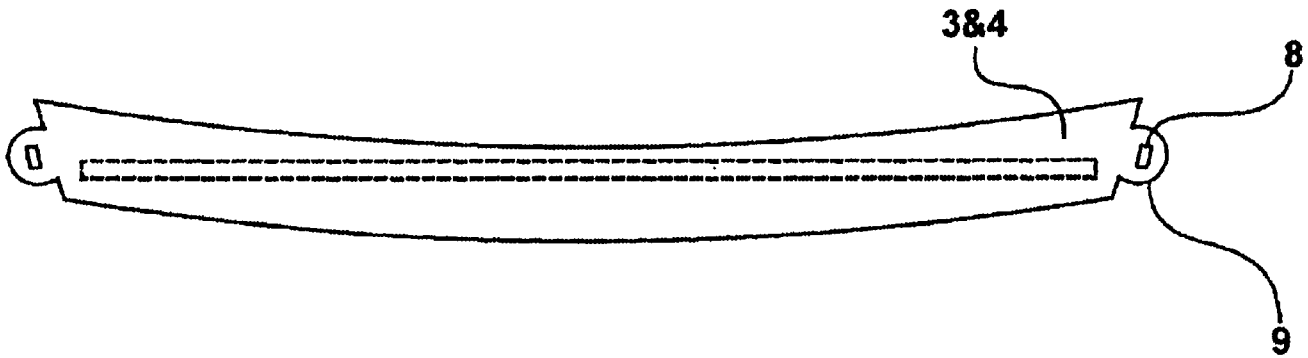
Figure 4C:
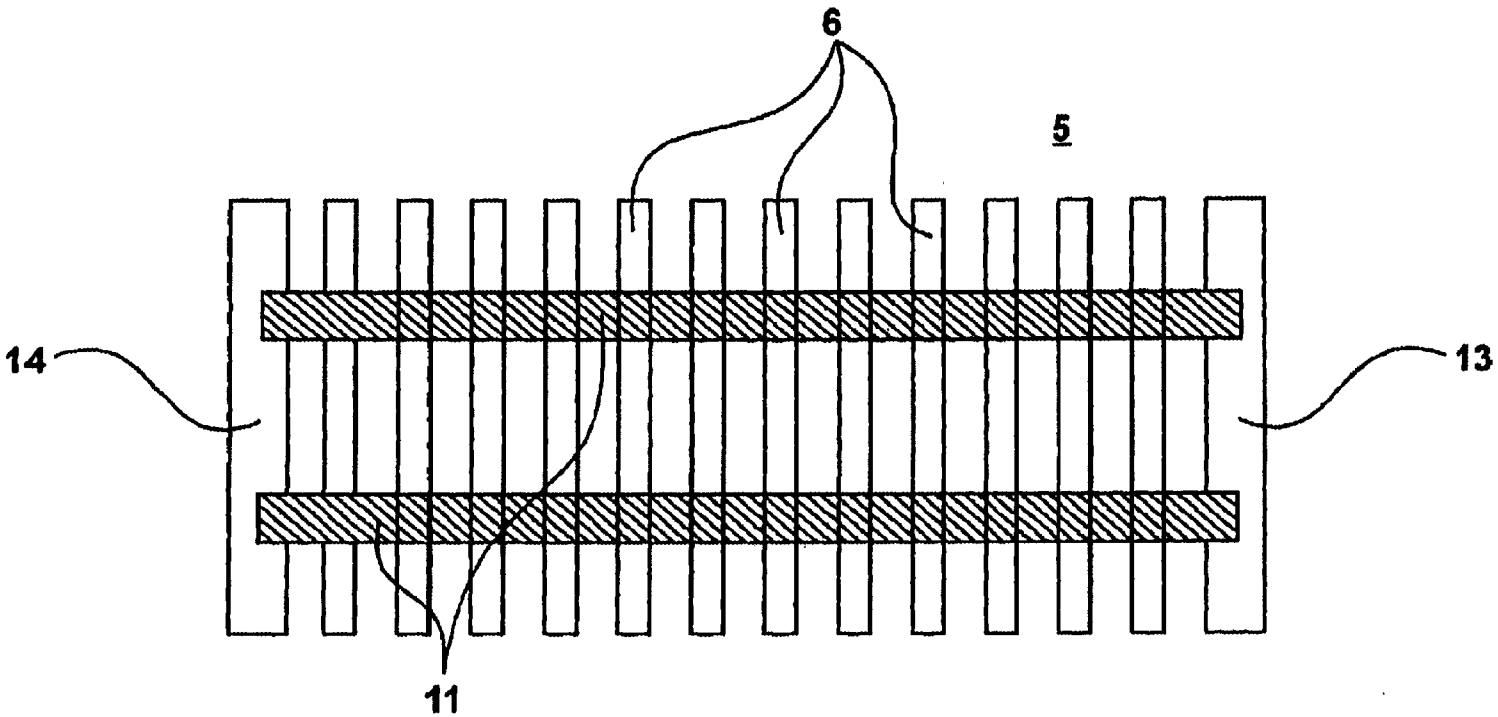
Figure 4D:
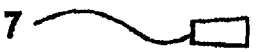
Figure 5:
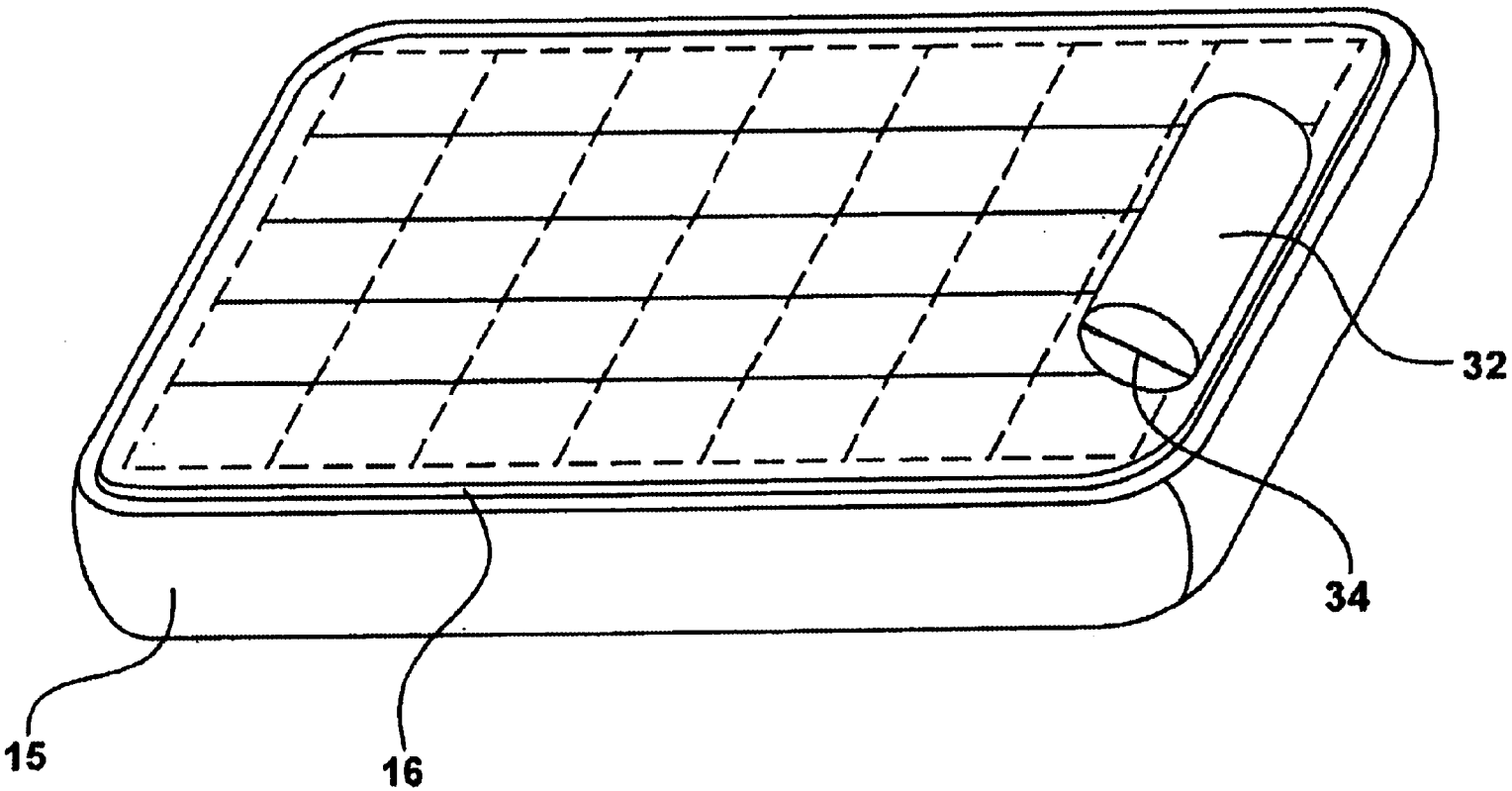
FIG. 5 is a perspective view of an air mattress with a quilt and pillow thereon.

Referring to FIGS. 1 and 2, the bed frame is made from wood and consists of two end boards forming a headboard 1 and a footboard 2 connected by two plank-like stringers 3 and 4 that support a bed base 5 formed by a series of parallel slates 6. The inside face of each stringer 3 and 4 is provided with a rail 50 on which the ends of slats 6 rest. The stringers 3 and 4 are held in place by four wedges 7 (shown in FIG. 1) which co-operate with holes 8 in tongues 9 at the ends of the stringers 3 and 4. In use the tongues 9 pass through slots 10 (as shown in FIG. 4*a*) in the headboard 1 and footboard 2. The slats 6 of the bed base 5 are mounted on two rubberized fabric bands 11 and 12 secured between two beams 13 and 14 forming the end slats of the bed base 5 adjacent the headboard 1 and footboard 2 respectively.

FIG. 2 shows the assembled components of the bed frame that may be flat-packed for transportation. The separate components are shown in FIG. 4. The flat pack may include other bed components such as an air-mattress 15 (not shown) and a cotton quilted mattress cover 16 (not shown). A pillow (not shown) and a non-woven micro-porous cotton pillowcase 32 (not shown) may also be included in the flat pack.

The pillowcase is tightly seamed on three sides closed at one end to a fine in-laid zip fastener 34. The pillow is fitted with non-allergenic material such as crimped Terelene® or hollow fibre material. Such pillowcases and pillows are washable to ensure that any Dust Mites cannot thrive thereon.

As shown in FIG. 2 the bed frame may be located in the corner of a room, illustrated by walls 17 and 18. It can be seen from FIG. 2 that the top extremity 19 of the headboard 1 abuts the wall 17 and that protruding extremities 20 and 21 on the headboard 1 and footboard 2 respectively abut the wall 18. The headboard 1 is contoured with a convex upper edge 22 and concave sides 23 and 24. As shown in FIG. 1 feet 25 and 26 are provided at the bottom of the footboard 2 by an arch 27. The headboard 1 is similarly contoured. The extremities 19, 20 and 21 ensure that the mattress 15 which in use lies on the bed base 5 between the stringers 3 and 4 is held away from the wall so that air may circulate between the mattress 15 and the walls 17 and 18. The spacing between the slats 6 allow the lower side of the air filled mattress 15 to be well aired. The spacing between the slats 6 also allows skin scales to drop through the bed frame onto the floor.

The headboard 1 is contoured so that the extremities 19 and 20 and the corresponding extremity 21 on the footboard 2 make point contact with the walls 17 and 18. The headboard 1 and footboard 2 are formed from a planar block of wood. The end boards 1 and 2 have straight sides and a straight top but this format would create a line contact with the walls and hence reduce the free airflow around the bed. The curved top of the end boards 1 makes a point contact with the wall 17 because it is inclined to the vertical.

Figure 3:
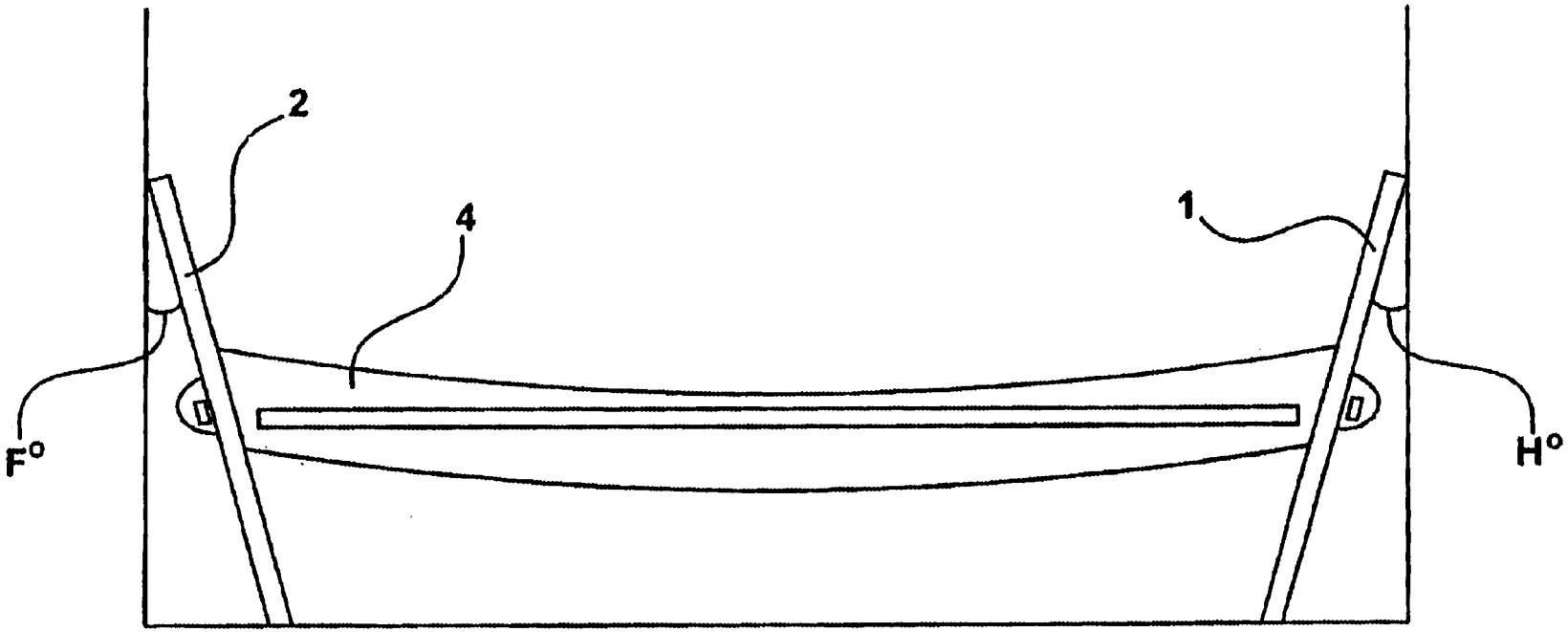
FIG. 3 shows a cross section of the bed frame on the line 3—3 of FIG. 2.

Referring now to FIG. 3 it can be seen that the headboard 1 and footboard 2 are inclined outward from the bed. It has been found from trials that the angle H of inclination of the headboard 1 to the vertical may lie between 5° and 25°. The footboard 2 is inclined to the vertical at an angle F that is preferably the same as angle H. It will be appreciated that the height and shape of the headboard 1 and the footboard 2 do not need to be identical but aesthetically the appearance is improved if the bed is symmetrical. It will also be appreciated that the inherent strength of the bed frame is improved if the bed is symmetrical from side-to-side and from end-to-end. The end boards 1 and 2 are preferably inclined to the vertical at 15°.

The stringers 3 and 4 are contoured so that they are deeper at their extremities where they butt against the end boards 1 and 2 than they are in their centre. This enables a sleeper to get into and out of the bed more easily. This contouring is achieved by curving the upper edge of the stringers with a lesser radius of curvature than the lower edge. In one embodiment of the bed the upper edge has a radius of 5.6 meters and the lower edge has a radius of 13.3 meters. The depth of the stringers at their centre is 0.145 meters and the depth at their ends is 0.2 meters.

The design of the bed enables air to circulate around the bed. The bedding material consists of easily washed and dried material to prevent the infestation of the House Dust Mite.

As shown in FIGS. 4*a*–4*d* the components of the bed can be flat-packed for ease of storage, transport and sale. The basic components for the flat pack consist of the end boards 1 and 2; the stringers 3 and 4; the mattress support base 5; and, fixing means such as wedges 7 for connecting the stringers between the end boards 1 and 2.

The flat pack may also include allergen-avoidance bedding such as: an air mattress 15; a cotton covered quilt 16; and, a cotton non-woven micro-porous pillow cover.

Once the bed has been assembled the inflated air mattress 15 is placed on the support base 5. The mattress 15 is covered by the washable cotton quilted covering 16, and a pillow is zipped into the non-woven micro-porous cotton pillowcase. A readily cleanable duvet completes the allergen-free bed ready for use.

The construction of bed is intended to remind a user sensitive to the House Dust Mite that it is important to maintain a good air flow about the bed and that clean dry bedding is essential. The House Dust Mite cannot live for more than a few hours in sunlight. Therefore it is preferable to expose the bedding to sunlight whenever possible.

It will be appreciated that the described embodiment of the invention is provided by way of example and the bed or components thereof may be made from other material than wood. Other variants are possible within the scope of the invention so as to provide good air flow around an allergen-free bed environment.

What is claimed is:

1. An allergen-avoidance bed comprising:

two end boards forming a headboard and a footboard, both of the end boards being substantially planar and inclined outwardly from the bed at an angle between 5° and 25° to a vertical, and said end boards each having a curvilinear upper edge which is profiled such that each said upper edge will provide a substantially point contact with a wall to optimize air flow around said end boards and such that the bed cannot be located against a wall in a manner that would compromise the free flow of air around the bed;

a pair of stringers for connecting the headboard to the footboard;

said end boards each projecting sideways in an arc so as to extend outwardly beyond the stringers to ensure that the bed cannot be located closely adjacent a wall in such a way that airflow around the bed would be significantly impeded; and a mattress base support for supporting an air-mattress between said stringers.

2. A bed as claimed in claim 1 in which the angles of inclination of the two end boards are equal.

3. A bed as claimed in claim 1 in which the mattress base support includes a series of parallel wooden slats mounted on two belts which extend between a beam adjacent the headboard and a beam adjacent the footboard.

4. A bed as claimed in claim 1 in which both stringers include substantially identical plank-like members that are mounted in parallel between the headboard and the footboard.

5. A bed as claimed in claim 1 in which an inside face of both stringers is provided with a rail on which the mattress base support rests.

6. A bed as claimed in claim 1 in which the stringers are smoothly shaped along lengths thereof such that a depth of the stringers is greater at ends thereof than at a center thereof.

7. A bed as claimed in claim 1 in which each stringer has a shape such that an upper edge thereof is curved at a lesser radius than a curvature of a lower edge thereof.

8. A bed as claimed in claim 1 in which the stringers are secured to the headboard and the footboard in spaced relation above a ground surface on which the bed is positioned.

9. A bed as claimed in claim 1 in which the bed is flat-packed.

10. A bed as claimed in claim 9 in which components of the bed are packed flat together with an air-mattress and a quilt filled with padding formed from an easily washable and driable material.

11. A bed as claimed in claim 10 further including a cover for a pillow.

12. A bed as claimed in claim 11 in which the pillow cover is closed on one side by a fine zip fastening.

13. A bed as claimed in claim 11 in which the quilt includes a cotton material and the cover for the pillow includes a non-woven micro-porous synthetic material.

14. A bed as claimed in claim 13 in which a cover of the quilt absorbs skin scales shed by a sleeper in the bed and the pillow cover of a non-woven micro-porous synthetic material substantially prevents all skin scales and house dust mites from passing therethrough.

15. A bed as claimed in claim 1 in which the bed is constructed from wood having rounded corners and sealed with a non-allergenic surface treatment.

16. A bed as claimed in claim 1 in which each end board has at least one open area at a lower edge thereof to optimize air flow around said end board.

17. A bed as claimed in claim 16 in which each said open area has a substantially semi-circular shape.

18. A bed as claimed in claim 1 in which said end boards each project sideways in an arc so as to provide a substantially point contact with a wall against which side edges of said bed are pushed.

* * * * *